US005679207A

United States Patent [19]

Palone et al.

[11] Patent Number: 5,679,207

[45] Date of Patent: Oct. 21, 1997

[54] NON-ALTERNATING LAP SPLICING DEVICE

[75] Inventors: Thomas W. Palone, Rochester; Frank Castrignano, Fairport, both of N.Y.

[73] Assignee: Eastman Kodak Company, Rochester, N.Y.

[21] Appl. No.: 626,787

[22] Filed: Apr. 2, 1996

[51] Int. Cl.[6] ..... B65H 21/00

[52] U.S. Cl. ..... 156/507; 156/73.4; 156/159; 156/502; 156/580.1; 242/553; 242/554.1; 242/554.5; 242/556

[58] Field of Search ..... 156/159, 502, 156/507, 73.4, 580.1; 242/551, 553, 554.1, 554.5, 556

[56] References Cited

U.S. PATENT DOCUMENTS

| | | | |
|---|---|---|---|
| 2,596,189 | 5/1952 | Wieking | 242/555.5 |
| 3,245,861 | 4/1966 | Roshkind | 156/505 |
| 3,317,153 | 5/1967 | Raymond | 242/555.5 X |
| 3,841,944 | 10/1974 | Harris, Jr. | 156/159 X |
| 3,850,778 | 11/1974 | Gnage | 156/502 |
| 3,939,032 | 2/1976 | Taitel et al. | 156/505 |
| 4,029,538 | 6/1977 | Vance, Jr. | 156/502 |
| 4,170,506 | 10/1979 | Marschke | 156/159 |
| 4,190,475 | 2/1980 | Marschke | 156/157 |
| 4,219,378 | 8/1980 | Marschke | 156/502 |
| 4,234,365 | 11/1980 | Shimizu et al. | 156/64 |
| 4,374,576 | 2/1983 | Ryan | 242/58.4 |
| 4,501,630 | 2/1985 | Kiuchi | 156/159 |
| 4,629,531 | 12/1986 | Katoaka | 156/504 |
| 5,066,346 | 11/1991 | Long et al. | 156/157 |
| 5,207,859 | 5/1993 | Jacobs | 156/502 |
| 5,273,228 | 12/1993 | Yoshida et al. | 242/58.1 |

FOREIGN PATENT DOCUMENTS

| | | | |
|---|---|---|---|
| 3401608 | 8/1985 | Germany | 156/502 |
| 4-308141 | 10/1992 | Japan | 242/552 |

OTHER PUBLICATIONS

"CTC Automatic Lap Splicers", Mar. 1993.

"Turreting Lap Splicer Type ST-800", one page promotional description (undated).

*Primary Examiner*—Mark A. Osele

*Attorney, Agent, or Firm*—Mark G. Bocchetti

[57] ABSTRACT

A non-alternating lap splicing apparatus for successively splicing rolls of web material is enclosed in a bifurcated housing with a separate access door for each of two compartments therein. There is a driven spindle in each of the compartments, each for supporting a stock roll of web. There is a separate film inlet path for each of the stock rolls. An oscillator assembly having a cutting knife and an ultrasonic horn means is mounted in the housing. The web outlet path is through the oscillator assembly. When one of the rolls is nearly spent, that roll is automatically stopped and the web is cut by the knife to create a trailing end. The oscillator assembly then pivots to align with the film inlet path for the stock roll within the other compartment. The lead end of the new stock roll is automatically positioned under the trailing end of the spent stock roll and the ultrasonic horn bonds the webs together. The overlapping lap of the splice is always trailing and on the same side of the web. The compartment containing the spent stock roll can be manually reloaded with a new stock roll in safety. When the operator opens the access door of one of the components, all components contained within that compartment are automatically de-energized.

12 Claims, 13 Drawing Sheets

NON-ALTERNATING LAP SPLICING DEVICE

BACKGROUND OF THE INVENTION

1. Field of the Invention

This invention relates generally to web splicing and, more particularly, to lap splicing the tail end of the proceeding or substantially spent length of web to the lead end of the following or new length of web.

2. Brief Description of the Prior Art

A variety of splicing apparatus are known in the prior art. Such splicing apparatus are adapted to splice various webs including paper, tape, and film. Splicing is usually accomplished through means of adhesive tape, heat sealing, or ultrasonic bonding. The structure of the actual splice is typically either a lap splice or a butt splice.

For example, U.S. Pat. No. 3,245,861 to Roshkind discloses a web splicer for use in label printing equipment in which the lead end of the following or new length of web is manually trimmed and the length of tape is applied across the trimmed end. The preceding or old length of web is then stopped as its source spool is emptied and its tail end is trimmed. The new lead end and applied strip of tape are then pressed against the old tail end to form an overlapping joint.

U.S. Pat. No. 3,939,032 to Taitel et al discloses a web butt splicer in which the new lead end is trimmed manually and a length of tape is applied across the lead end. The old tail end is then trimmed at the same location and the two trimmed ends are pressed together to form a butt joint.

U.S. Pat. No. 4,234,365 to Shimizu et al shows a web butt joining system in which the old web and the new web are threaded between a pair of cutting wheels which trim their ends and convey the two ends in abutment to a pair of taped applicator wheels which place strips of tape on both sides of the butt joint.

U.S. Pat. No. 4,501,630 discloses an apparatus for splicing a leader to magnetic tape in which the leader and tape are fed along parallel, coplanar guide grooves in a receiving table which is movable transversely to permit either the leader or the tape to move into a coplanar guide groove on an adjacent receiving table. After the lead end of the tape and the tail end of the leader have been trimmed in separate operations, the two ends are butted and a strip of tape is applied.

U.S. Pat. No. 4,629,531 to Kataoka shows an apparatus for joining sheet ends for such as might be used in a newspaper printing plant. The new web is trimmed manually and glue is then applied to its lead end. Then the old web is stopped and trimmed, after which the lead end of the new web is overlapped with the tail end of the old web.

U.S. Pat. No. 5,066,346 to Long et al discloses an apparatus for splicing webs such as photographic film in which the lead end of the new web and the tail end of the old web are trimmed at the parallel edges of their respective input platens and then shifted into abutment for application of a strip of tape. An automatic tape dispenser cuts tape into predetermined lengths, transfers the lengths of tape to a vacuum applicator wheel, and then rolls the lengths of tape across the abutted lead and tail ends.

U.S. Pat. No. 4,170,506, U.S. Pat. No. 4,190,475 and U.S. Pat. No. 4,219,378, all to Marschke, teach apparatus for splicing webs. All of the splices are made by adhesive and are alternating lap splicers.

There is nothing in the prior that teaches an oscillating lower clamp and splicing assembly which moves between two positions with splicing capable of being made at both positions thereby allowing for a non-alternating lap splice. Further, the prior art fails to teach an apparatus which allows for a bifurcated cabinet thereby permitting the operator to unload a spent roll of film and load a new roll such that the operator is not exposed to the dangers of having to place his or her hands within an energized and operating apparatus with film strips moving therethrough at high speed.

SUMMARY OF THE INVENTION

It is, therefore, an object of the present invention to provide an apparatus for making web splices where the splice is a non-alternating lap splice.

It is further an object of the present invention to provide a web splicing apparatus particularly suited to splice photographic film webs such that the splice is always made on the trailing emulsion of the web.

Still another object of the present invention is to provide a lower clamp and splicing assembly which is capable of oscillating between two different positions whereby splices can be made at either position.

Yet another object of the present invention is to provide an apparatus where one side of the apparatus is completely de-energized for operator interaction while the other side of the apparatus continues to operate but remains closed from the operator.

Briefly stated, these and numerous other features, objects, and advantages of the present invention will become readily apparent upon a reading of the detailed description, claims and drawings set forth herein. These objects, features and advantages are accomplished through the use of an oscillating lower clamp and splicing assembly which oscillates between a first position aligned with the first film gripper translator assembly and a second position aligned with a second film gripper translator assembly. The first film gripper translator assembly is associated with a film web wound on a first stock roll. The second upper clamp assembly is associated with a second film web wound about a second stock roll. The apparatus is built within a bifurcated cabinet such that the first film gripper translator assembly and the first stock roll are located on one side thereof and the second film gripper translator assembly and second stock roll are located on the opposite side thereof. Two separate doors are provided thereby allowing access to that side of the cabinet and to the stock roll which is not in operation.

When one stock roll is close to being spent, the apparatus of the present invention automatically stops the film web and clamps the film web in both the oscillating lower clamp and splicing assembly and the film gripper translator assembly. The film web is then cut thereby providing a trailing end having a fixed position within the oscillating lower assembly. The oscillating lower assembly then moves to its second position in line with the second film gripper translator assembly. An operator has previously loaded a new stock roll of film web on that side of the apparatus and inserted the lead end of the film web of the stock roll into the second film gripper translator assembly resulting in the lead end being located at a predetermined position. That lead end of the film web then automatically is caused to be inserted into the oscillating lower assembly to be positioned adjacent the trailing end of the now spent stock roll thereby allowing the leading and trailing ends to be positioned in an overlapping arrangement with the overlapping lap of the splice always on the trailing emulsion side of the web. The splice is preferably made by ultrasonic bonding. The spliced web can then continue to further operations such as to a spooler for placement in individual film canisters. While the second stock roll is being unwound, the operator can access the side of the apparatus containing the now spent first stock roll. That side of the apparatus containing the now spent first stock roll is automatically de-energized upon the operator opening the door to that side of the bifurcated cabinet. The operator can then, in safety, remove the now spent first stock roll and load a new stock roll therein and position the lead end of the film web contained thereon in the first film gripper translator assembly. Upon doing this, the operator can close the access door to that portion of the apparatus such that another non-alternating lap splice can be made automatically when the second stock roll is substantially spent. Thus, the operator is not, at any time, exposed to that portion of the apparatus through which the web is moving at high speeds. In fact, when the operator opens either of the access doors to the bifurcated cabinet, that side of bifurcated cabinet opened is automatically de-energized meaning that electric power, pressurized air, and all potential energy have been terminated, and that any pressurized air stored in the various components is automatically dumped.

DESCRIPTION OF THE PREFERRED EMBODIMENTS

Figure 1:
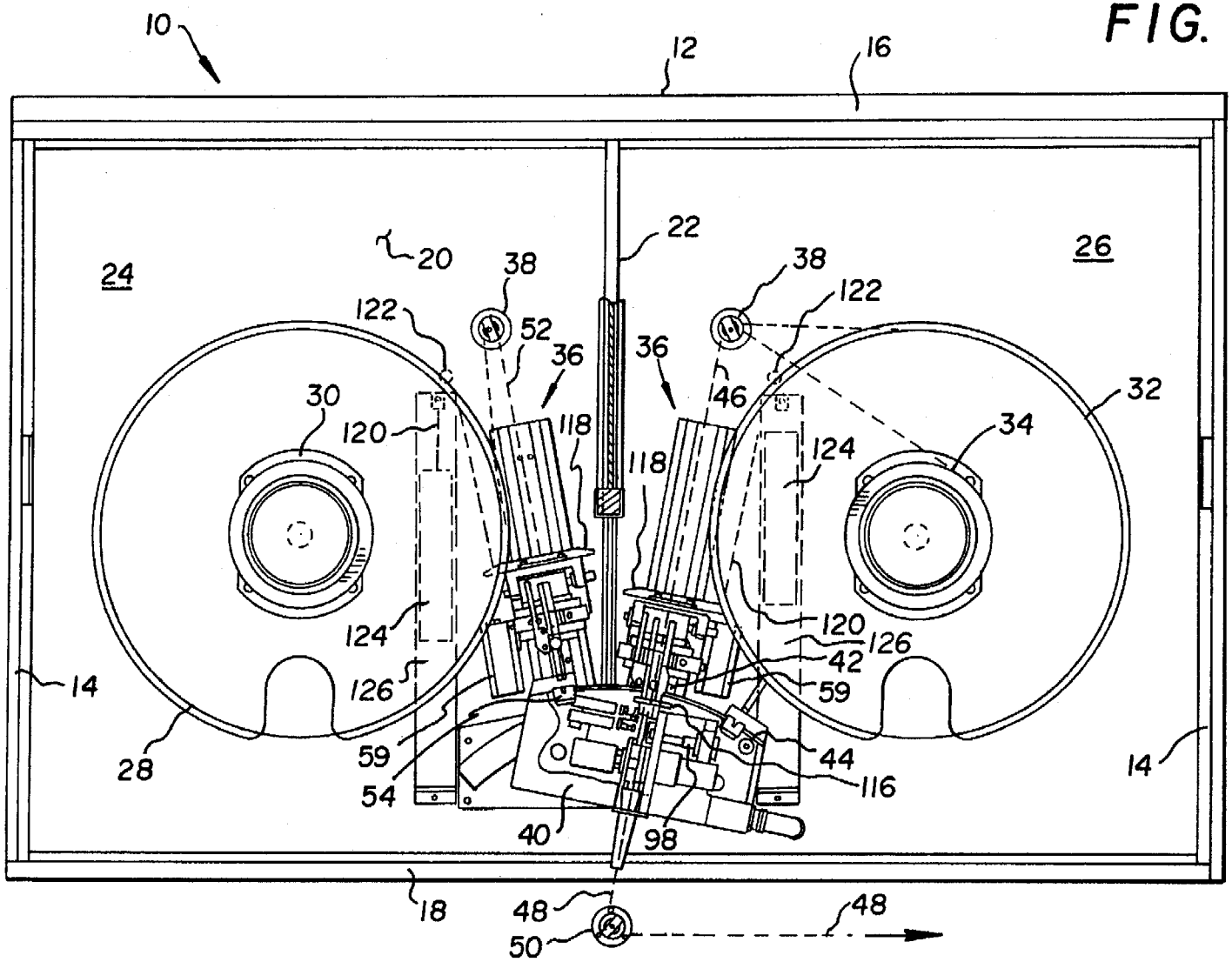
FIG. 1 is a front elevational view of the splicer of the present invention with the doors of the cabinet removed.

Turning first to FIG. 1 there is shown the splicing apparatus 10 of the present invention which is preferably contained within a cabinet or housing 12. The cabinet 12 includes side walls 14, top wall 16, bottom wall 18 and rear wall 20. Cabinet 12 further includes a pair of access doors (not shown). The interior of cabinet 12 is divided by an intermediate wall 22 projecting from rear wall 20. Intermediate wall 22 substantially divides the interior of cabinet 12 into a left compartment 24 and a right compartment 26. One door serves as access to the left compartment 24 and the other door serves as access to the right compartment 26.

Located in the left compartment 24 is left stock roll 28 of photographic film supported on a left driven spindle 30. Located in the right compartment 26 is right stock roll 32 of photographic film supported on a right driven spindle 34. Associated with each of the driven spindles 30, 34 is a film gripper translator assembly 36 and a roller encoder 38. Positioned within cabinet 12 beneath intermediate wall 22 is oscillator assembly 40. Oscillator assembly 40 includes a cut-off clamp module and an ultrasonic horn module to be discussed in detail hereinafter. Oscillator assembly 40 further includes a web inlet slot 42 through an upper plate 44. Oscillator assembly 40 oscillates from a first position where a web inlet slot 42 aligns with the film gripper translator assembly 36 in the left compartment 24 to a second position where the web inlet slot 42 aligns with the film gripper translator assembly 36 in the right compartment 26. As depicted in FIG. 1 the oscillator assembly 40 is shown in the first position.

Film unwinding in a counter clockwise direction from stock roll 32 travels along a first inlet path 46 around roller encoder 38 and down through film gripper translator assembly 36 in right compartment 26. The film continues through oscillator assembly 40 traveling along an outlet film path 48 and then around an idler roller 50. From there the film can be taken to a subsequent convening process. As depicted in FIG. 1, a new stock roll 28 is staged for splicing when stock roll 32 is near spent. The film again is positioned to unwind in a counter clockwise direction and travel along a second film inlet path 52 such that the film wraps about roller encoder 38 in the left compartment 24 and into the film gripper translator assembly 36. The film is held by the film gripper translator assembly 36 such that the lead end is positioned against reference stop 54 which is affixed to oscillator assembly 40. When stock roll 32 is depleted right driven spindle 34 is automatically stopped. The film web is then simultaneously clamped within the gripper translator assembly 36 in the right compartment 26 and in the oscillator assembly 40. The web is then cut creating a trailing end which remains clamped within oscillator assembly 40. The film gripper translator assembly 36 within right compartment 26 then retracts expired web along film path 46 from oscillator assembly 40. Oscillator assembly 40 then pivots from the first position to the second position as described above aligning web path 48 with web path 52 thereby presenting the lead end of stock roll 28 into oscillator assembly 40 such that a splice can be made therein.

Figure 2:
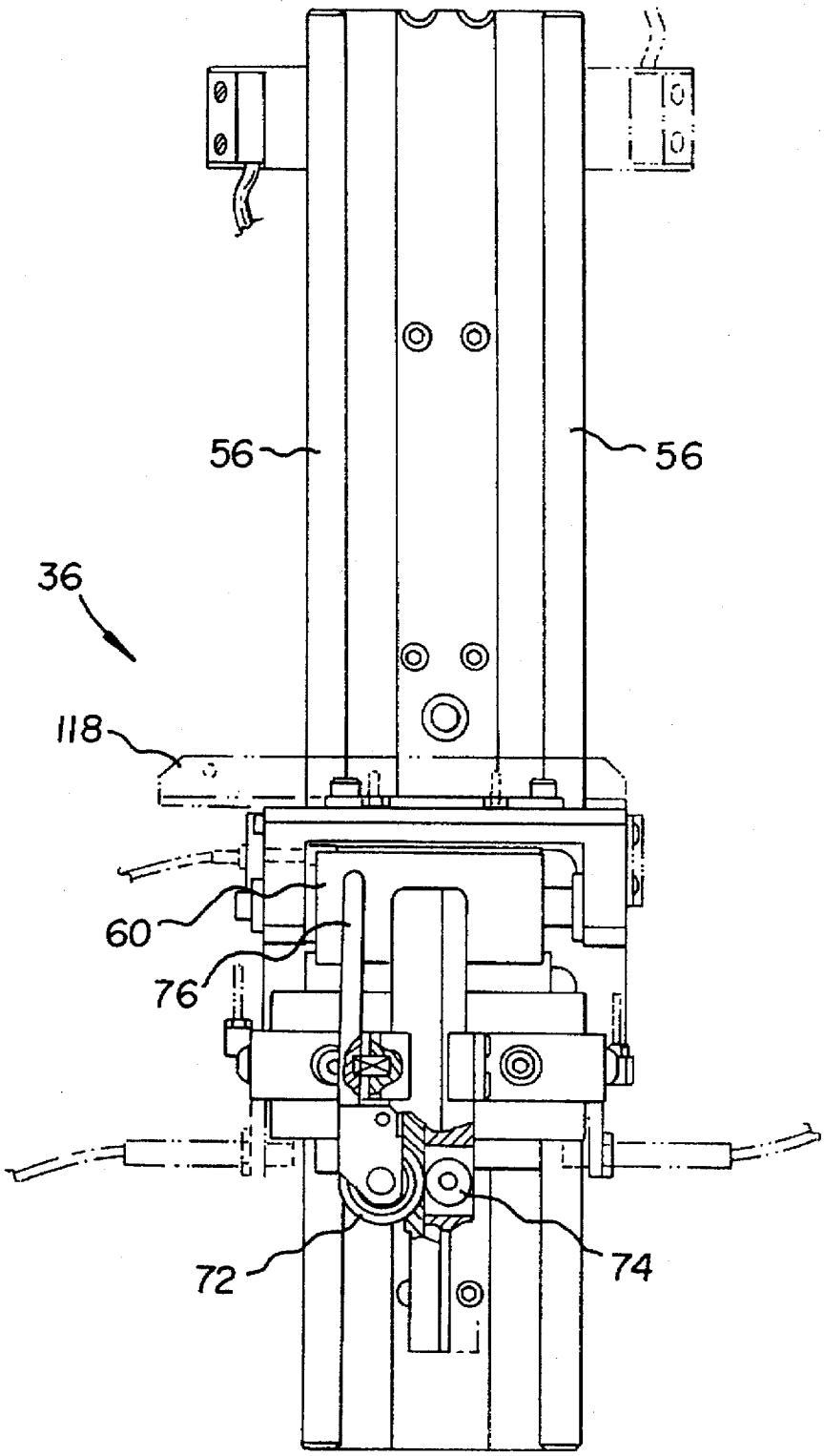
FIG. 2 is a front elevational view of the film gripper translator assembly of the present invention.
Figure 3:
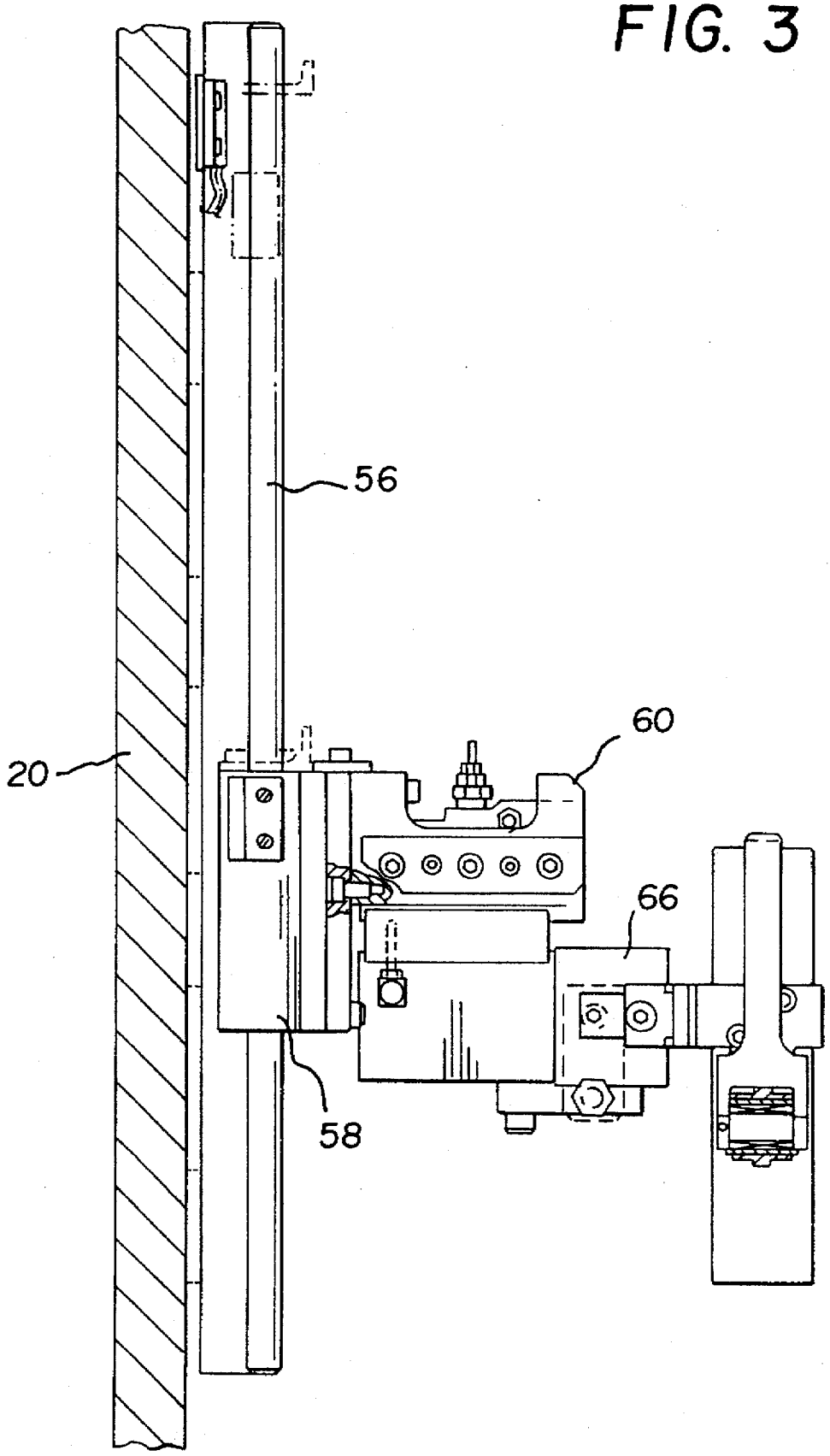
FIG. 3 is side elevational view of the film gripper translator assembly of the present invention.
Figure 4:
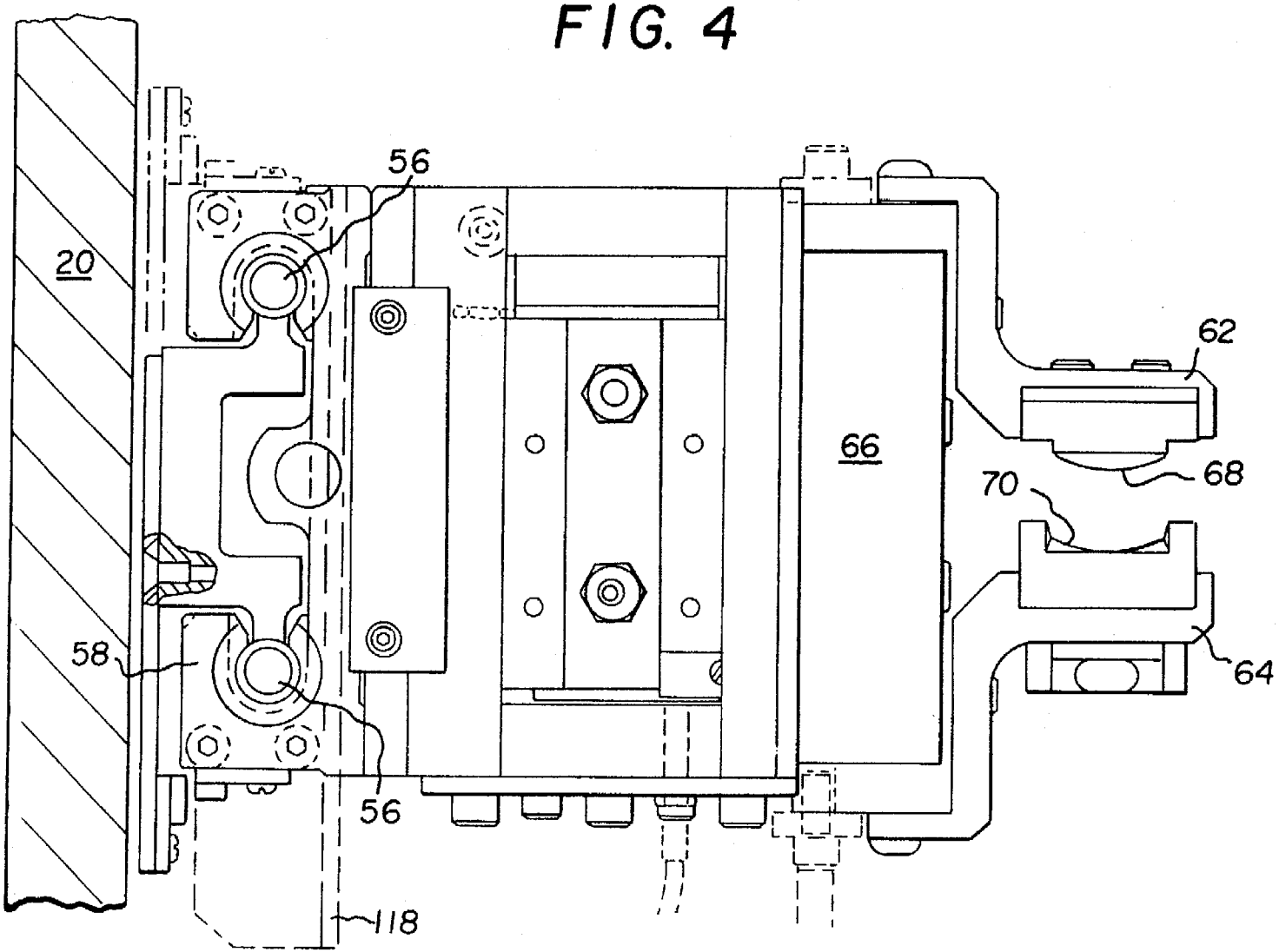
FIG. 4 is a top plan view of the film gripper translator assembly of the present invention.

Looking next at FIGS. 2, 3 and 4 there is shown detailed views of the film gripper translator assemblies 36. Each film gripper translator assembly 36 includes a linear bearing assembly which includes a pair of fixed rails 56 and a slide block 58. It has been found that, in conjunction with the present invention, an appropriate linear bearing assembly to use is Model #2DA-08-008 L18 as supplied by Thompson Industries, Inc. of Port Washington, N.Y. Attached to slide block 58 is a pneumatic translator slide 60. An example of an appropriate pneumatic translator slide 60 to use in conjunction with the present invention is Model #SA042 as supplied by PHD, Inc. of Fort Wayne, Ind. Mounted to translator slide 60 is a spring return pneumatic actuator 66 having film grippers 62, 64 extending therefrom. An appropriate spring return pneumatic actuator 66 is Model #15360-1-31 as manufactured by PHD, Inc of Fort Wayne, Ind. Film grippers 62, 64 are shown in the actuated position in FIG. 4 with the spring return biasing 62, 64 to a closed position when de-energized.

Film gripper 62 has a male configuration with a convex film engaging surface 68. Film gripper 64 has a female configuration with a concave film engaging surface 70. When film grippers 62, 64 are closed on the film web, the film web conforms to film engaging surfaces 68, 70 such that it has an arcuate cross section increasing the film's longitudinal beam strength for preventing film curl or buckle of the lead end when positioned against the reference stop 54. Attached to the film grippers 62, 64 are, antibackup pinch rolls 72, 74. Antibackup pinch roll 72 is spring loaded and is biased against antibackup pinch roll 74. Antibackup pinch roll 72, preferably has an outer surface of polyurethane. There is a lever 76 which an operator can use to overcome the spring bias of antibackup roll 72.

Figure 5:
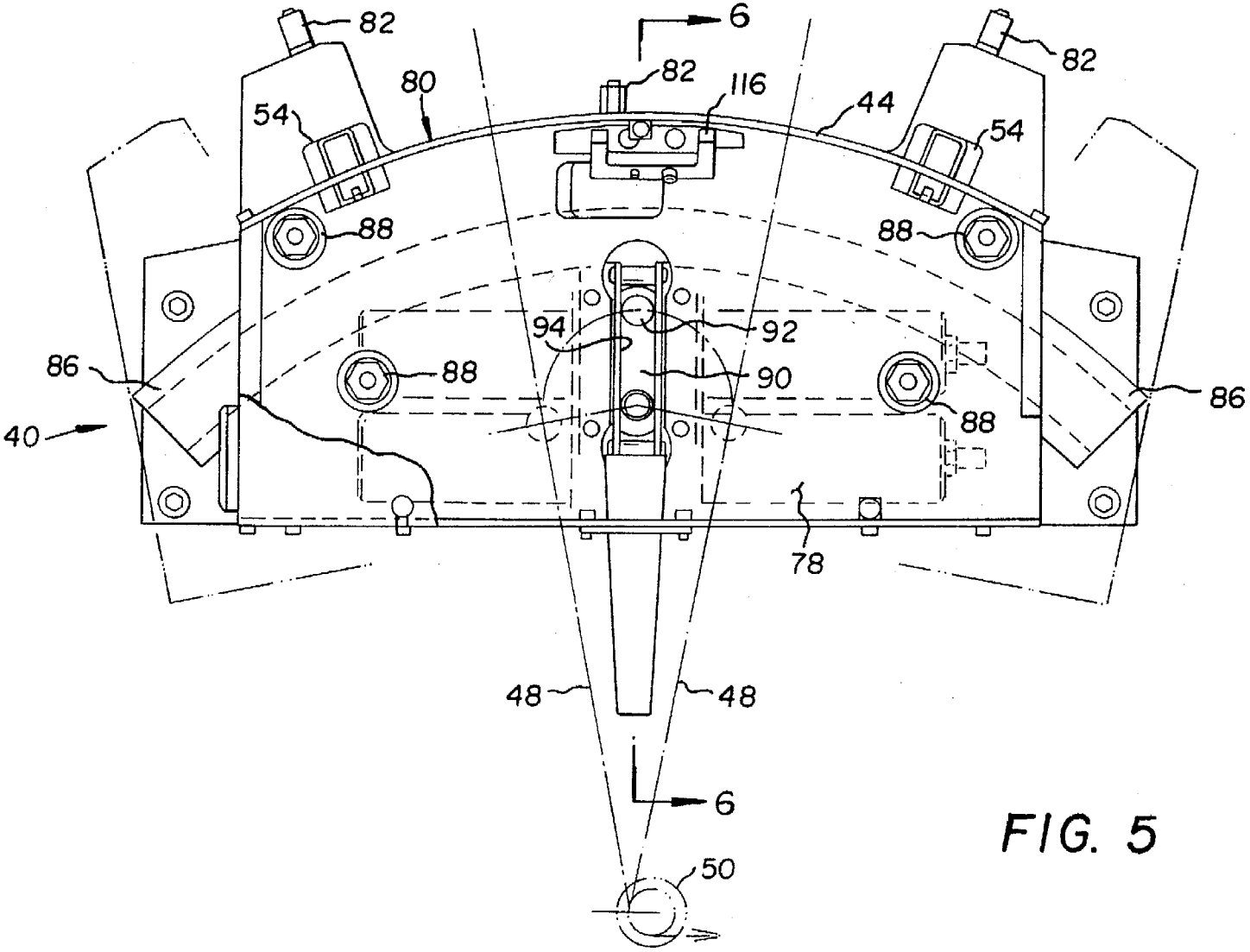
FIG. 5 is a front elevational view of the oscillator assembly of the present invention with the clamping and ultrasonic horn modules removed therefrom for purposes of clarity.
Figure 6:
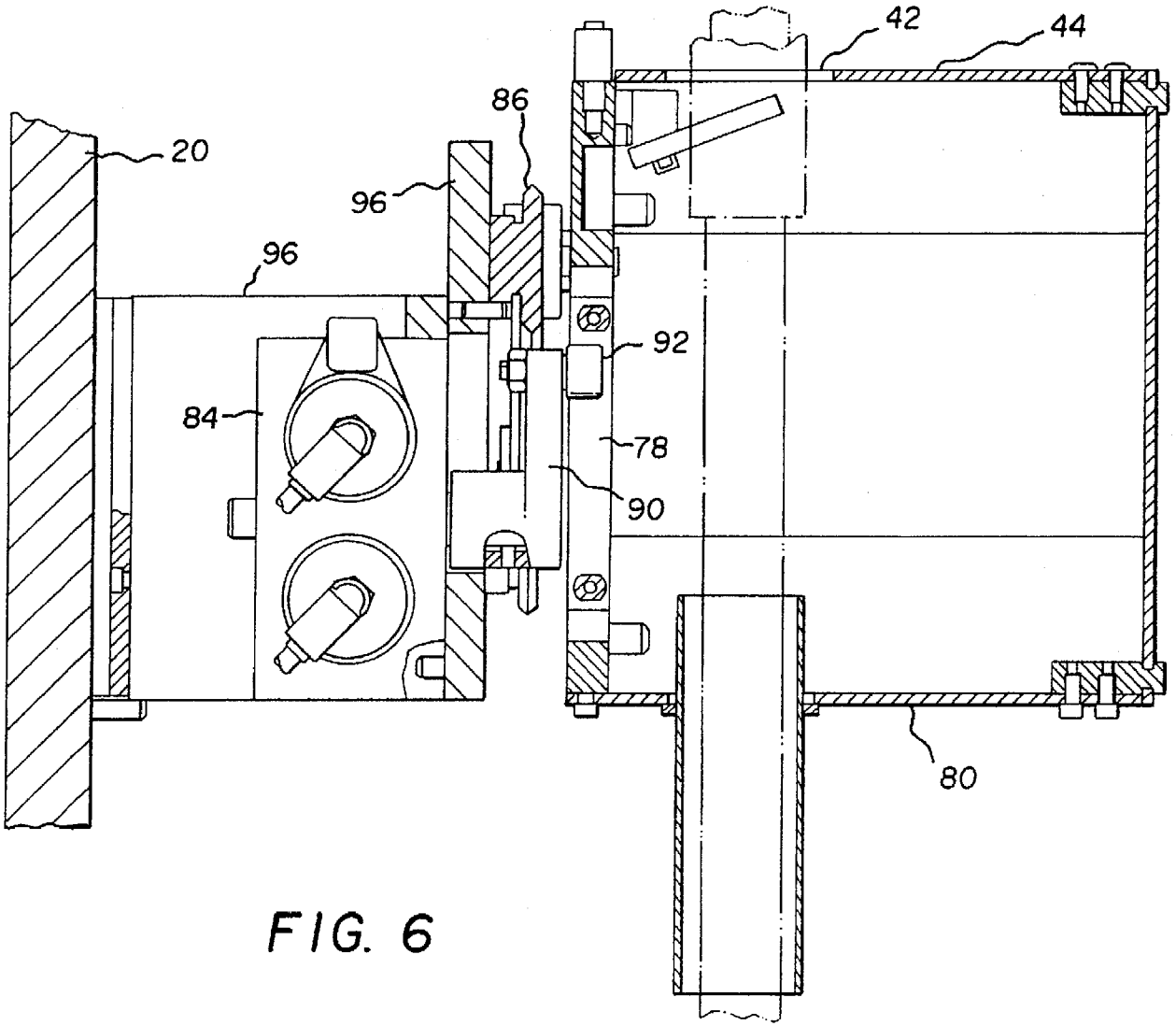
FIG. 6 is a cross sectional view of the oscillator assembly of the present invention taken along line 6—6 of FIG. 5 with the clamping and ultrasonic horn modules removed therefrom for purposes of clarity.
Figure 7:
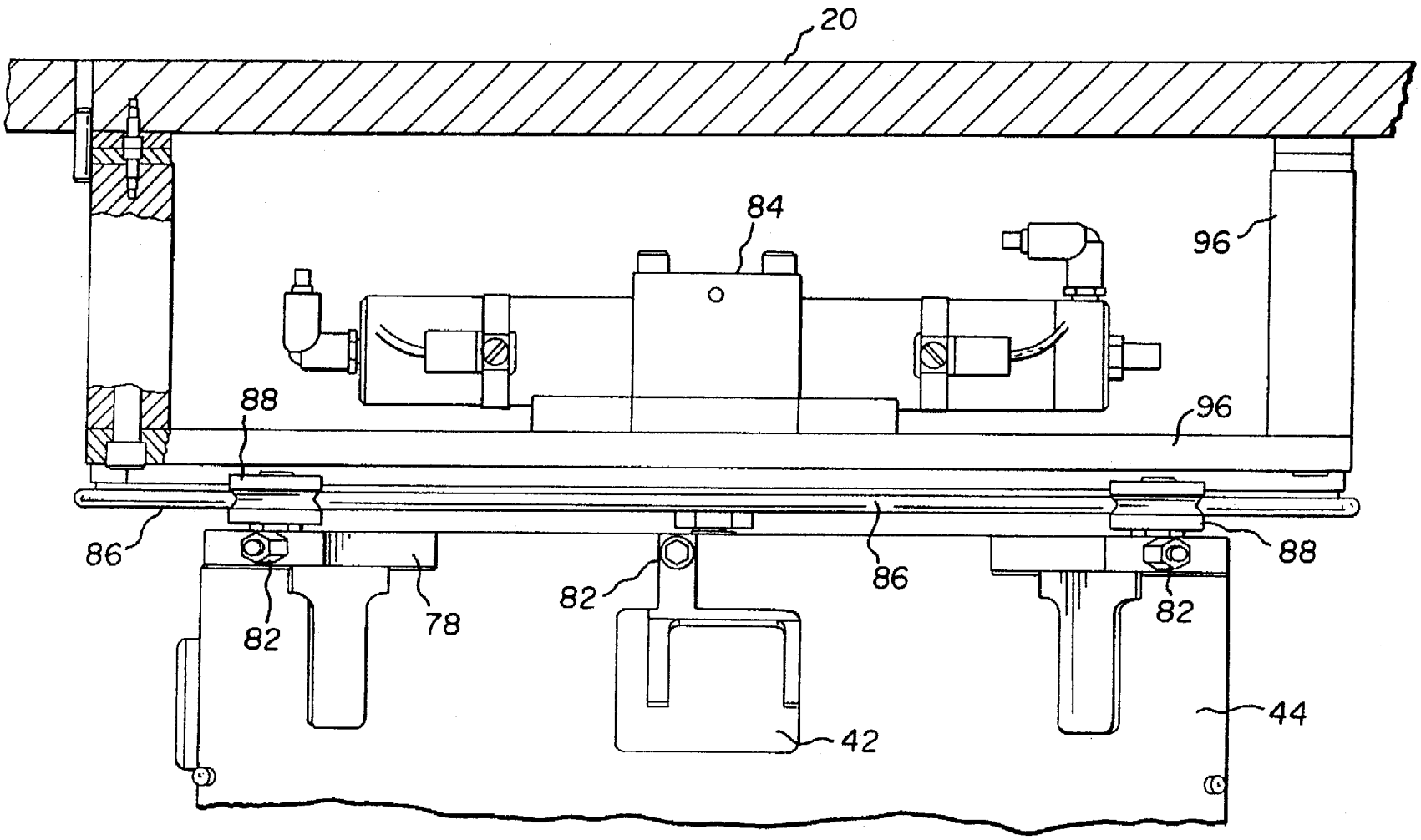
FIG. 7 is a top plan view of the oscillator assembly of the present invention with the clamping and ultrasonic horn modules removed therefrom for purposes of clarity.

Turning next to FIGS. 5, 6 and 7 there is shown the oscillator assembly 40 with the clamping modules and the ultrasonic horn removed for purposes of clarity. Note that oscillator assembly 40 is shown in mid-oscillation in FIG. 5 with the first and second positions of oscillator assembly shown partially in ghost. Oscillator assembly 40 includes a support plate 78 which has mounted to it a housing or enclosure 80 which includes the previously mentioned upper plate 44. Mounted to support plate 78 are reference stops 54 and rest stops 82. Support plate 78 is articulated through an arc having its center on a point tangent to the surface of idler roll 50 along film outlet path 48. This motion is provided by a pneumatic rotary actuator 84 constrained by a curved cam rail segment 86 and four v-groove roller bearings 88 which are attached to support plate 78. Two of the v-groove roller bearings 88 are positioned above curved cam rail 86 and two of the v-groove roller bearings 88 are positioned below curved cam rail 86. The pneumatic rotary actuator 84 drives support plate 78 by means of crank 90 affixed at one end to the shaft of the pneumatic rotary actuator 84 and having a cam follower 92 extending from the opposite end thereof. Cam follower 92 projects into a cam path slot 94 in support plate 78. Because the path of the cam follower 92 is greater than 90 degrees rotation from vertical in both directions to achieve both the first and second positions, the oscillator assembly 40 becomes mechanically locked when the rotary actuator 84 is de-energized. Rotary actuator 84 is mounted on support bracket 96 which extends from rear wall 20. Also mounted to support bracket 96 is the curved cam rail segment 86.

Figure 8:
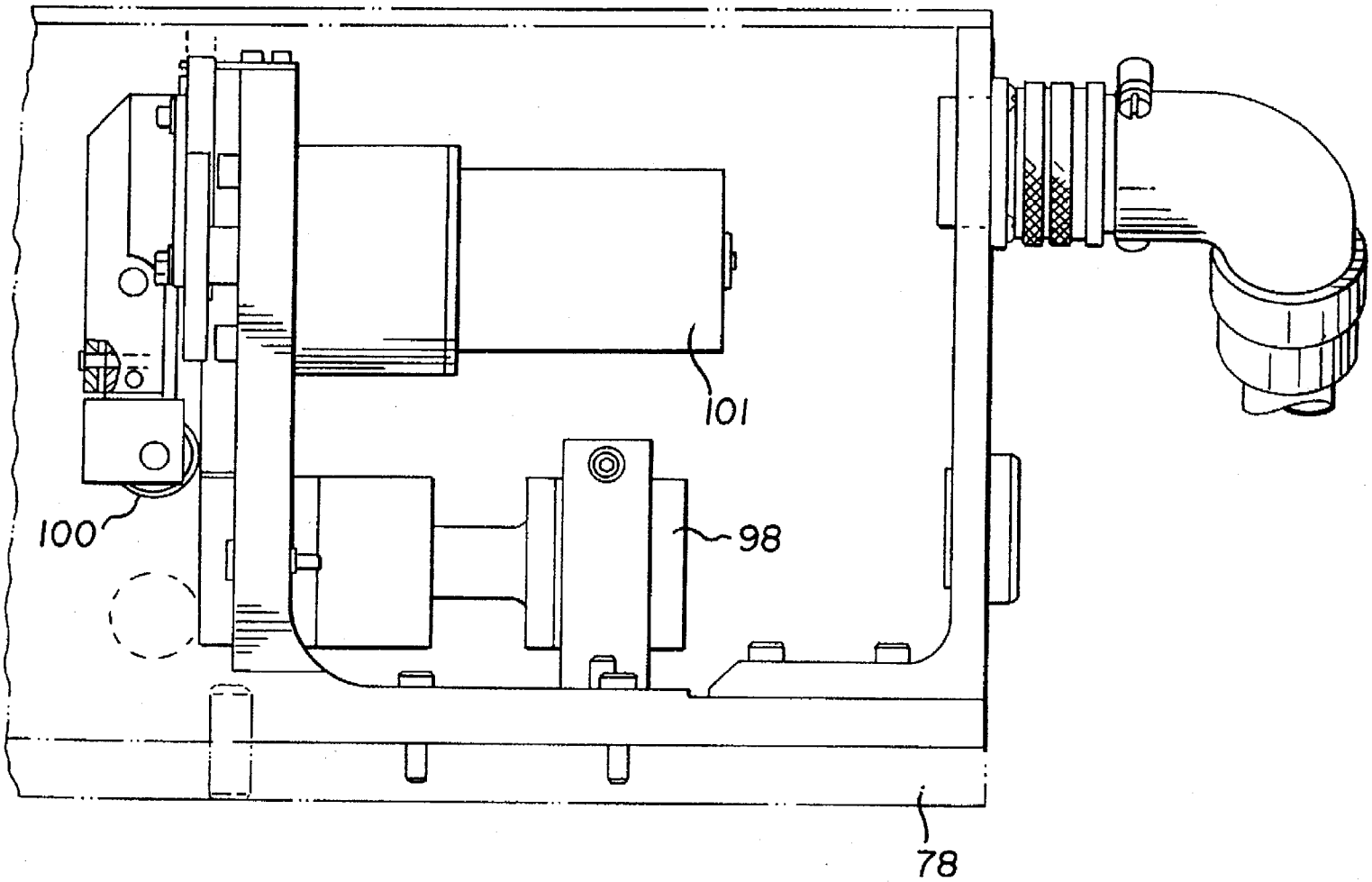
FIG. 8 is a top plan view of the ultrasonic horn module.
Figure 9:
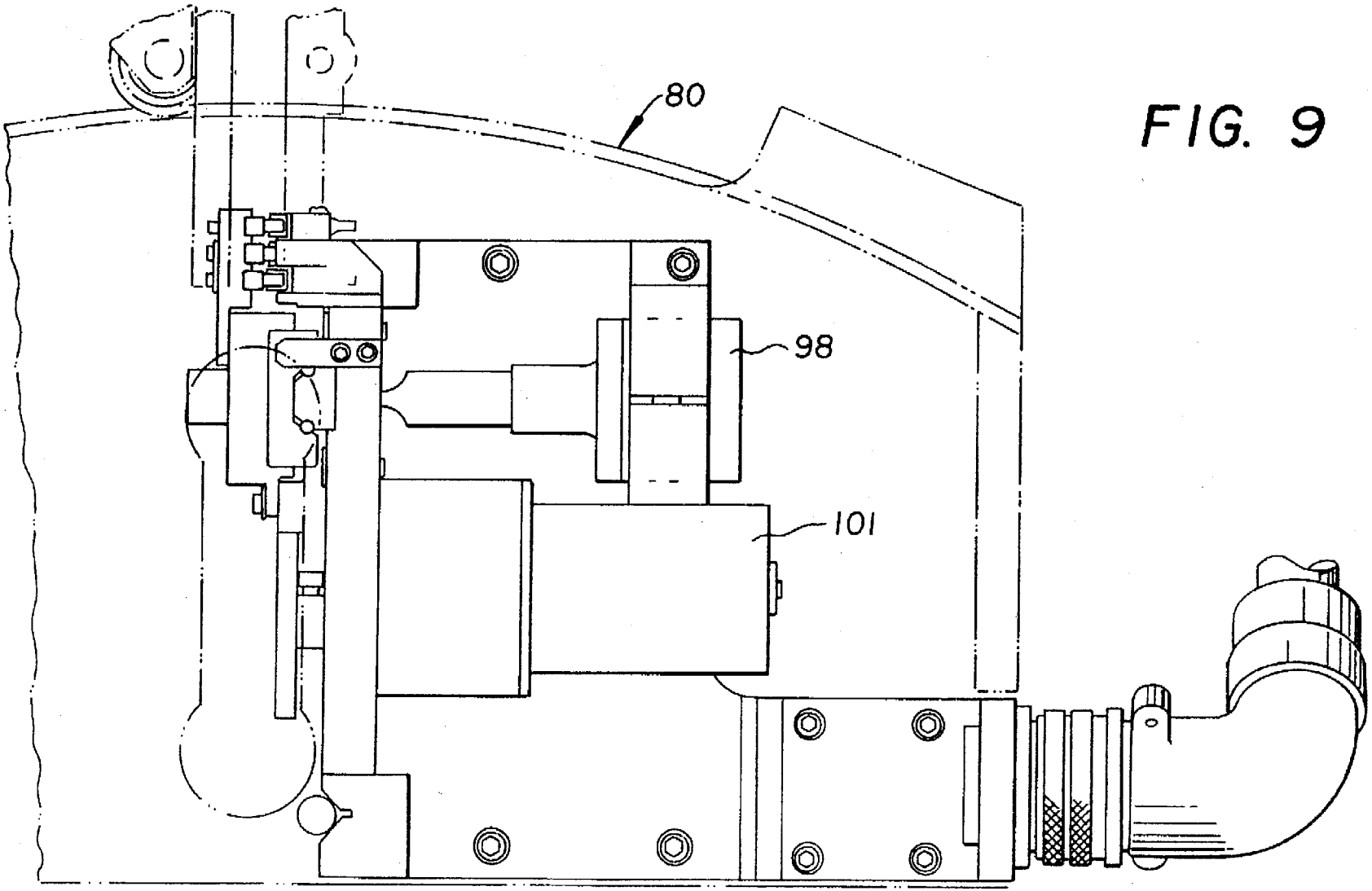
FIG. 9 is a front elevational view of the ultrasonic horn module.

Contained within housing or enclosure 80 and mounted to support plate 78 is the ultrasonic horn module which includes a fixed 50 kHz horn 98 and a rolling anvil 100 which reciprocates in a path across the width of ultrasonic horn 98 (see FIGS. 8 and 9). An electric motor 101 drives the reciprocating motion of rolling anvil 100. The ultrasonic horn 98 and rolling anvil 100 operate in a manner substantially similar to the ultrasonic film splicer described in U.S. Pat. 4,029,538 to Vance, Jr.

Figure 10:
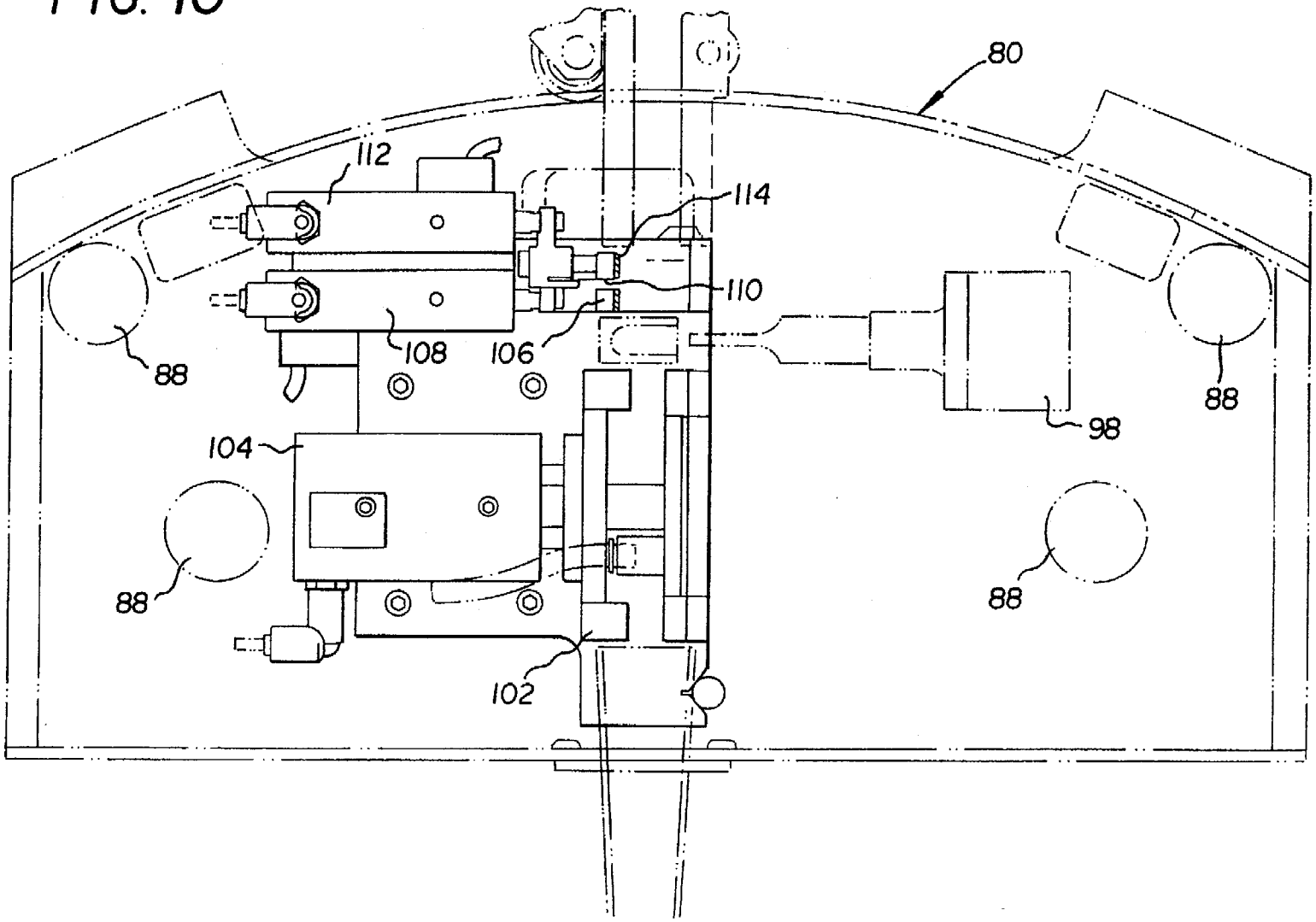
FIG. 10 is a front elevational view of the clamping and cut-off modules of the present invention with the oscillator housing and ultrasonic horn show in ghost.
Figure 11:
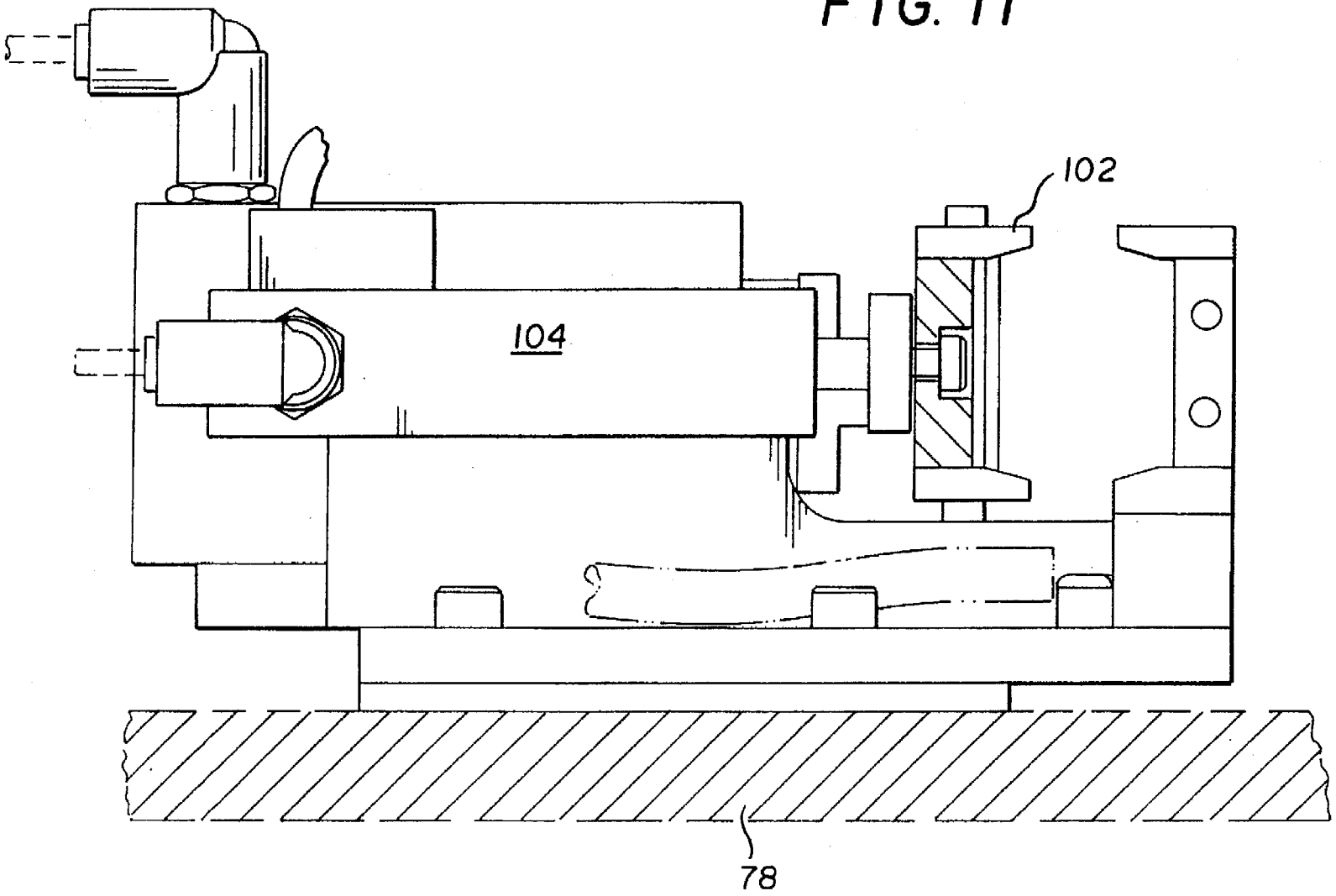
FIG. 11 is a top plan view of the lower clamping module within the oscillator assembly.

Also contained within housing or enclosure 80 and mounted to support plate 78 is the cut-off/clamp module shown in FIGS. 10 and 11. The cut-off/clamp module includes a lower film clamp 102 actuated by a non-rotating spring return pneumatic cylinder 104. This lower film clamp 102 maintains film tension in outlet path 48 after a cut has been made and during oscillation of oscillator assembly 40. There is further included an upper film clamp 106 within housing 80 actuated by a non-rotating spring return pneumatic cylinder 108. Upper film clamp 106 ensures continued web registration during the ultrasonic sealing process. Positioned immediately above upper film clamp 106 is a film cutoff knife 110. The film cut-off knife 110 is actuated by a non-rotating spring return pneumatic cylinder 112. Slidably mounted on the film cut-off knife 110 is a spring loaded stripper 114 which clamps the film above the film-cut-off knife 110 during the cutting operation. There is also contained within housing 80 a photoelectric detector 116 (see FIG. 5) which is affixed to support plate 78. The photoelectric detector 116 is located a precise distance from the ultrasonic horn 98.

Affixed to the top of each of the slide blocks 58 is a lift bracket 118 (see FIGS. 1, 2 and 4). There is a cable 120 attached to each lift bracket 118. Each cable 120 extends up and around a pulley 122. The opposite end of the cable 120 is attached to a counterweight 124 which resides within a tube 126. Each counterweight 124 is sized to be about two pounds less than weight of each film gripper lift assembly 36. This counterweight arrangement provides tension to web 46, 52 between the film gripper lift assemblies 36 and the stock rolls 28, 30.

In operation, with film web being unwound from a stock roll 28, 32 in one of the compartments 24, 26, the operator prepares the opposite compartment 24, 26 with a new stock roll 28, 32. For example, with film web unwinding from the right stock roll 32 with the oscillator assembly 40 residing in a position in alignment with the right film gripper translator assembly 36, the operator can open the access door to the left compartment 24. Various locking and sensor means and circuit interrupts can be employed in conjunction with each of the access doors such that when a particular access door is opened, all electrical power to the components within that compartment 24, 26 is terminated, all pneumatic pressure to the components in that particular compartment 24, 26 is relieved, and all potential energy of the components with that particular compartment 24, 26 has been terminated. In other words, that particular compartment 24, 26 is de-energized and, for the purposes of this invention, the term "de-energized" is intended to mean terminating electrical power, potential energy, and pneumatic pressure, both active and stored. The use of devices such as interlocking safety switches to provide circuit interrupts is well known to those skilled in the art and need not be described in detail here. Suffice it to say that access to either of the compartments 24, 26 cannot be accomplished without the operator first encountering at least one of such devices resulting in that compartment 24, 26 being de-energized. Thus, continuing with the example of the operator opening the access door to the left compartment 24 for the purpose of loading a new stock roll 28, any potential injury to the operator is significantly reduced in that the components within the opened compartment 24 are de-energized. Further, the operating components in the right compartment 26 are separated from the operator by means of the intermediate wall 22 and the access door to the right compartment 26. The components in the right compartment 26 will likewise be de-energized when the operator seeks to gain access thereto by attempting to open the access door to the right compartment 26. Preferably, the de-energizing circuitry de-energizes the driven spindle 30, 34, the film gripper translator assembly 36 and the oscillator assembly 40.

Once a compartment is opened, the operator removes the spent stock roll, for example, from the left driven spindle 30 and installs a new stock roll 28 thereon. The operator can then thread the film web of the new left stock roll 28 around roller encoder 38 and into film gripper translator assembly 36. The lead end of the film must be manually positioned to the correct length relative to the film grippers 62, 64. The correct length for the lead is determined by having the film end butt against a reference stop 54. The film is prevented from retracting from the film grippers 62, 64 by antibackup pinch roll 74. The antibackup pinch roll 74 can be defeated by the operator through the use of lever 76 to overcome the spring bias of spring loaded pinch roll 72. It should be understood that film grippers 62, 64 are spring loaded closed and must be pneumatically actuated to open.

Once the operator has threaded the film such that the lead end abuts the reference stop 54, the operator can close the access door to the left compartment 24. Upon closing such access door, the components within the left compartment 24 are re-energized, meaning that power and pneumatic pressure are restored. A servo motor (not shown) is then used to size the newly installed left stock roll 28. Sizing is important in order to ensure that the machine can determine when each stock roll nears full depletion. In order to size the stock roll, the servo motor for the particular stock roll 28, 32 rotates clockwise to thereby raise the film gripper translator assembly 36 through tension in the film web. During this movement of the film gripper translator assembly 36, roller encoder 38 and an encoder on the stock roll driven spindle 30, 34 count the degrees of rotation of their respective shafts. This information is fed to an algorithm to calculate the size of the stock roll outside diameter which is needed by the servo control to run the rest of the stock roll. The algorithm, of course, must take into account web thickness so that the splicer of the present invention can be used with a variety of photographic film products. The servo stock roll motor then positions the film gripper translator assembly 36 at a height that is just off reference stop 54. Note that the film gripper translator assembly 36 is counter balanced with a counter weight 124 such that the film held by the pinch roll 72, 74 only has to support a few pounds, or just a fraction of the total weight of the film gripper translator assembly 36.

At this point, the automatic lap splicer of the present invention has been prepared with a new stock roll and is ready for a splicing sequence. Thus, in our example, as the right stock roll 32 nears completion, the servo motor for the right driven spindle 34 brings the right driven spindle 34 to a complete stop with only a few convolutions of film left on the now nearly spent right stock roll 32. The film gripper translator assembly 36 within the right compartment 26 is in its home position which coincides with the natural running web centerline or first inlet path 46. The film grippers 62, 64 in the right compartment 26 are de-energized. In such manner, the film grippers 62, 64 are closed by spring biasing thereby allowing the spring loaded pinch roll 72 and the antibackup pinch roll 74 to engage the film web. The lower film clamp 102 within the oscillator assembly 40 is then actuated by its associated spring return pneumatic cylinder 104 to maintain tension in the web along web path 48 during the cutting and splicing sequence. The film cut-off knife 110 with stripper 114 is then actuated to cut the web at a position between the lower film clamp 102 and film grippers 62, 64 thereby creating a trailing end of the depleted stock roll. At this point, the pneumatic lift cylinders 59 for each of the film gripper translator assemblies 36 are de-energized such that both slide blocks 58 are lifted up thereby raising film grippers 62, 64 to a position which is clear from rest stops 82 and web inlet slot 42 on oscillator assembly 40. This action of raising the film grippers 62, 64 also serves to remove the severed end of the depleted stockroll from the oscillator assembly 40. Preferably, the pneumatic lift cylinders 59 used to actuate each of the film gripper translator assemblies 36 are double acting cylinders which are extended full up in their home position.

The oscillator assembly 40 is then driven by crank 90 on pneumatic rotary actuator 84 along curved cam rail segment 86 such that the oscillator assembly 40 assumes the second position as described above where the second film inlet path 52 aligns with film outlet path 48. Lower film clamp 102 remains actuated in the closed position while the cut-off knife 110 with stripper 114 returns to its home position. Next, both pneumatic lift cylinders 59 controlling the film gripper translator assembly 36 are energized (pressurized) which retracts the cylinder rod. The slide block 58 associated with the depleted stock roll falls against rest stop 82. The slide block 58 associated with the new stock roll falls under the control of the stock roll servo motor such that when the end of the film is detected by the photoelectric detector 116, the servo motor for the driven spindle supporting the new stock roll will drive the end of the film down a predetermined distance for ultrasonic splicing. The photoelectric detector 116 is located at a fixed distance from the ultrasonic horn 98. Therefore, once the diameter of the new stock roll is calculated, the encoder on the servo motor will position the film correctly over the ultrasonic horn 98. The pneumatic translator 60 is then energized to move horizontally to place the lead end of the new stock roll on the ultrasonic horn 98. With the lead end of the new stock roll being held in the film gripper 62, 64 and with the trailing end of the spent stock roll still clamped in the lower film clamp 102, the upper film clamp 106 is energized to hold both the lead end of the new stock roll and the trailing end of the spent stock roll during the sealing operation. The ultrasonic horn 98 is then activated with the rolling anvil 100 moving there across thereby making the splice. The lower and upper film clamps 102, 106 hold the film securely during the splice to prevent the film ends from skewing as the rolling anvil 100 moves across the film. Film grippers 62, 64 then open and the pneumatic translator 60 returns the web to alignment with the appropriate film inlet path 46, 52. The lower and upper film clamps 102, 106 then open allowing the spliced film from the new stock roll to move through oscillator assembly 40 along outlet path 48 to downstream converting operations such as a spooler.

The present invention is controlled by a programmable logic controller such that the only manual operation that the operators need perform is the substitution of the new stock for a spent stock roll. Once the operator has installed a new stock roll, he need only wrap the lead end of this film web about the roller encoder 38 and insert the lead end between the spring loaded pinch roll 72 and the antibackup pinch roll 74 such that the lead end abuts a reference stop 54. All other operations described herein take place automatically under the control of a programmable logic controller such as a General Electric Company Fanuc Series 90-70 PLC. The bifurcation of the cabinet 12 allows the operator to perform the minimal manual operations required in safety separated from the energized portion of the splicer wherein the film is moving therethrough at a higher rate of speed.

Figure 12:
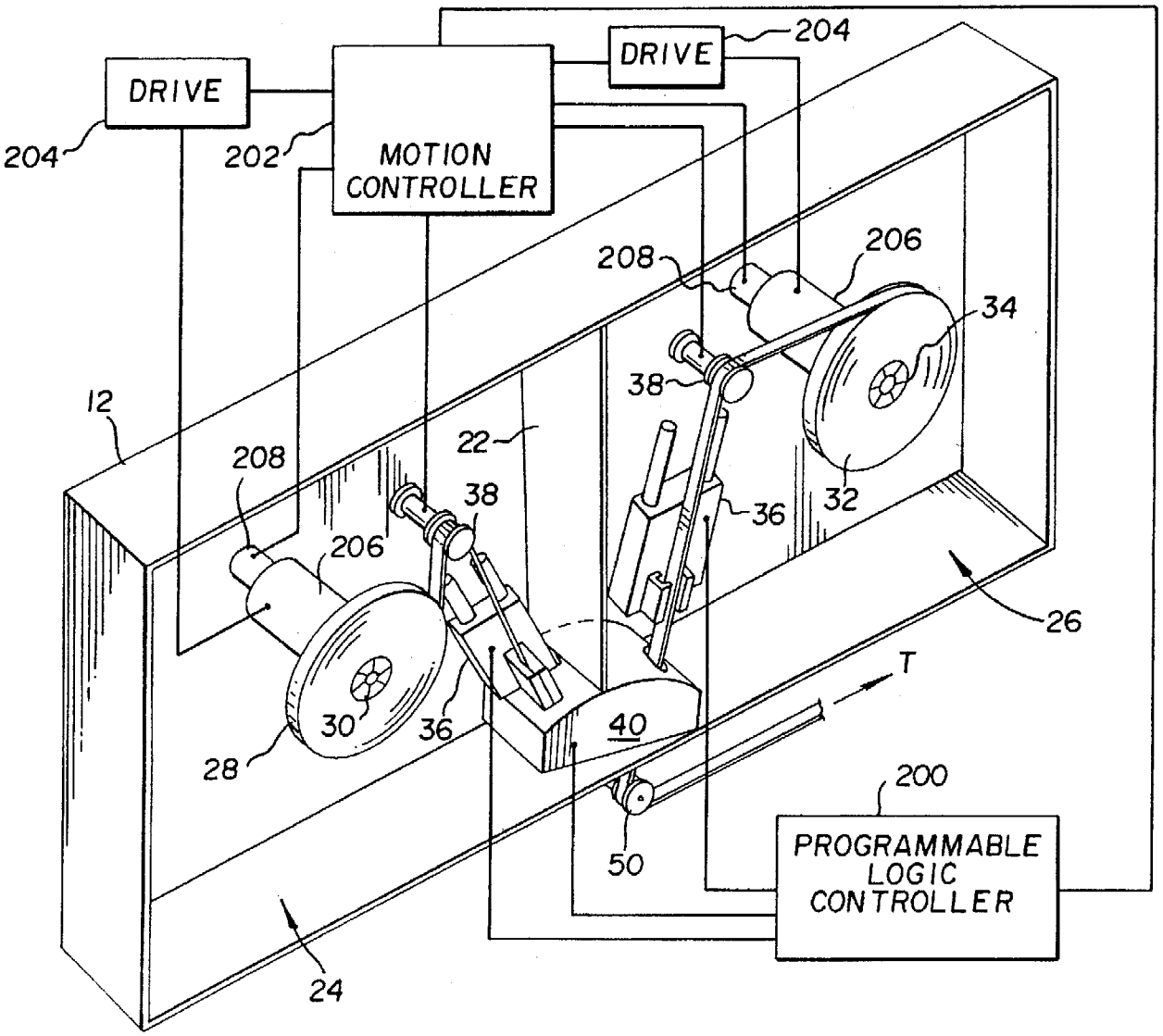
FIG. 12 is a schematic representation of the present invention with connections to a programmable logic controller.

Turning to FIG. 12, there is shown a schematic representation of the present invention with connections to a programmable logic controller 200. The programmable logic controller 200 communicates with the film gripper translator assemblies 36 and the oscillator assembly 40. For the sake of clarity, the individual components within the film gripper translator assemblies 36 and the oscillator assembly 40 are not depicted in FIG. 12. Those skilled in the art will recognize that, in communicating with the oscillator assembly 40, the programmable logic controller 200 actually communicates with pneumatic rotary actuator 84, ultrasonic horn 98, rolling anvil 100, electric motor 101, pneumatic actuator 104, pneumatic cylinder 108, pneumatic cylinder 112, and photo electric detector 116. Similarly, in communicating with the film gripper translator assemblies 36, the programmable logic controller 200 actually communicates with pneumatic lift cylinders 59 and pneumatic actuators 66.

The programmable logic controller also acts through a motion controller 202 which is connected via drives 204 to servo motors 206. In roll sizing operations, motion controller 202 receives signals from roller encoders 38, and encoders 208 connected to servo motors 206, or to driven spindles 30, 34.

Figure 13:
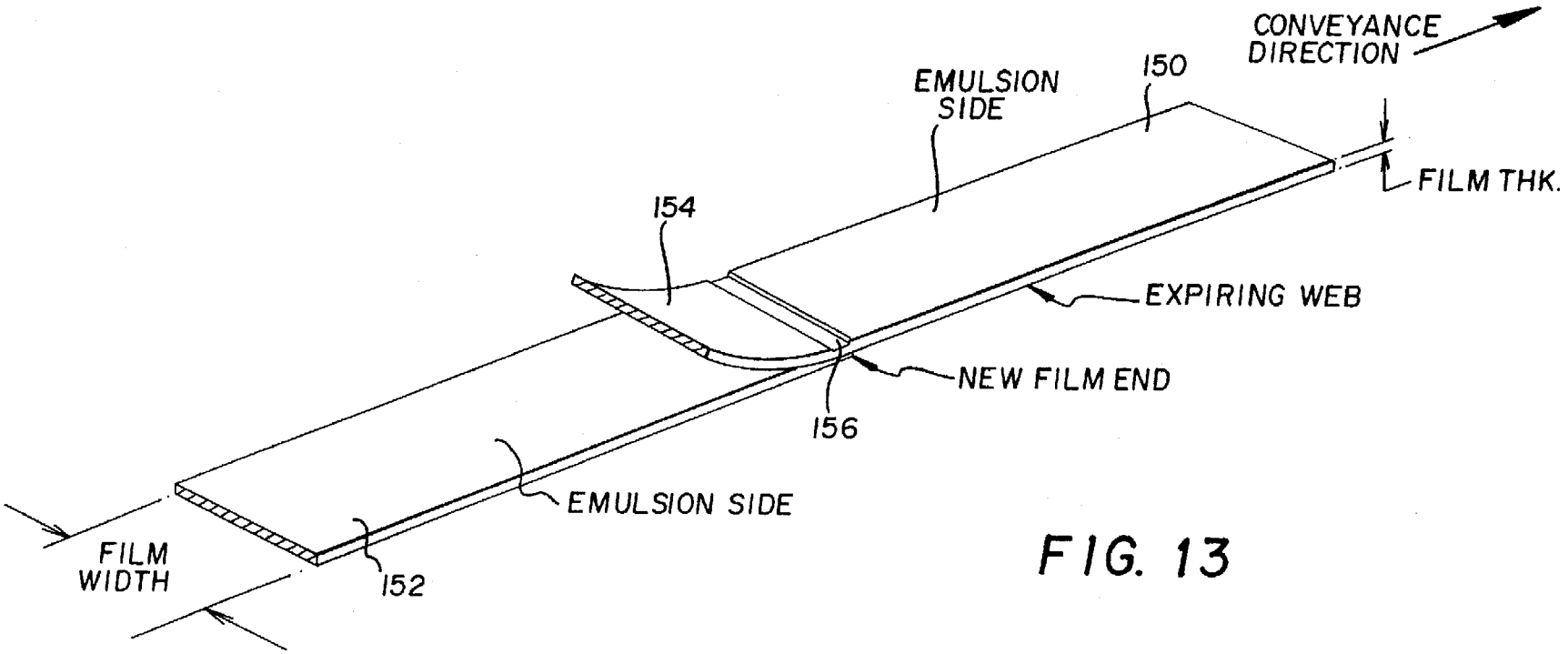
FIG. 13 is a perspective view of the an overlapping splice of two webs as made with the splicer of the present invention.

Further, because the oscillator assembly 40 moves between the first and second positions actually pivoting the film outlet path 48, the splice can be made such that the overlapping lap of the web is always on the trailing side and on the same side of the web. Thus, regardless of whether the oscillator assembly is in the first or second position, the resultant splice will look like the splice depicted in FIG. 13. The trailing end 150 of the nearly spent stock roll, with the emulsion side up, overlaps on top of the lead end 152 of the new stock roll. This creates a trailing flap 154 upstream of the ultrasonic seal 156. This can be beneficial to various downstream converting operations. For example, if the downstream converting operation is a spooler, where the film is wound into individual film spools and canisters in its final configuration for sale to the public, that film canister which actually contains the splice is unacceptable product. With the lap always on the trailing side and on the same side of the film, a photoelectric detector can be used in close proximity to the spooler to detect the overlapping lap of the splice just prior to its entry into the spooler to thereby identify the unacceptable film canister. Further, the non-alternating trailing lap splice is the only splice configuration which will transport through subsequent converting equipment without potential obstructions to the movement through such converting equipment of the splice itself.

From the foregoing, it will be seen that this invention is one well adapted to attain all of the ends and objects hereinabove set forth together with other advantages which are apparent and which are inherent to the apparatus.

It will be understood that certain features and subcombinations are of utility and may be employed with reference to other features and subcombinations. This is contemplated by and is within the scope of the claims.

As many possible embodiments may be made of the invention without departing from scope thereof, it is to be understood that all matter herein set forth and shown in the accompanying drawings is to be interpreted as illustrative and not to in a limiting sense.

What is claimed is:

1. A non-alternating lap splicing device for successively splicing rolls of web material, said device comprising:

(a) a first film gripper lift assembly;

(b) a second film gripper lift assembly adjacent said first film gripper assembly;

(c) an oscillator assembly having a cutting knife and a bonding means mounted therein, said oscillator assembly oscillating from a first position where said cutting knife and said bonding means are in line with said first film gripper assembly to a second position where said cutting knife and said bonding means are in line with said second film gripper assembly, said oscillator assembly positioning a trailing end of a substantially spent rolled web against a lead end of a new rolled web to create a lap slice where the overlapping lap of the lap splice is always trailing and on the same side of the film path downstream of said oscillator assembly.

2. A non-alternating lap splicing device for successively splicing rolls of web material as recited in claim 1 wherein:

said bonding means is an ultrasonic horn and anvil.

3. A non-alternating lap splicing device for successively splicing rolls of web material as recited in claim 1 wherein:

said first and second film gripper lift assemblies each are capable of traversing a guide rail to move toward and away from said oscillator assembly.

4. A non-alternating lap splicing device for successively splicing rolls of web material as recited in claim 1 further comprising:

a cabinet housing said first and second film gripper lift assemblies, said oscillator assembly, a first driven spindle for supporting a first rolled web and a second driven spindle for supporting a second rolled web, said cabinet including a first access door to said first film gripper lift assembly and said first driven spindle, and a second access door to said second film gripper lift assembly and said second driven spindle, said first film gripper lift assembly and said first driven spindle being automatically de-energized when said first access door is opened, said second film gripper lift assembly and said second driven spindle being automatically de-energized when said second access door is opened.

5. A non-alternating lap splicing device for successively splicing rolls of web material as recited in claim 1 further comprising:

means for positioning a lead end of said new rolled web to extend a predetermined distance into said oscillator assembly.

6. A non-alternating lap splicing device for successively splicing rolls of web material as recited in claim 1 further comprising:

means for automatically determining when a roll of web is substantially spent, said device stopping rotation of said substantially spent roll, said cutting knife then cutting the web of said substantially spent roll to prepare the trailing end, said oscillator assembly subsequently moving from said first position to said second position to automatically receive the lead end of the new roll.

7. A non-alternating lap splicing device for successively splicing rolls of web material as recited in claim 1 wherein:

said first and second film gripper lift assemblies each include a pneumatically actuated male gripping member and a pneumatically actuated female gripping member.

8. A non-alternating lap splicing device for successively splicing rolls of web material, said device comprising:

(a) a first web gripper lift assembly;

(b) a second web gripper lift assembly adjacent said first web gripper assembly;

(c) a first spindle means for supporting a first roll of web;

(d) a second spindle means for supporting a second roll of web;

(e) an oscillator assembly having a cutting knife and a bonding means mounted therein, said oscillator assembly oscillating from a first position where said cutting knife and said bonding means are in line with said first web gripper lift assembly to a second position where said cutting knife and said bonding means are in line with said second web gripper lift assembly, said cutting knife cutting the web of a substantially spent roll to thereby create a trailing end, said oscillator assembly positioning said trailing end of said substantially spent roll against a lead end of a new roll of web, said bonding means automatically splicing said trailing end and said lead end together to create a lap slice where the overlapping lap of the lap splice is always trailing and on the same side of the film path downstream of said oscillator assembly.

9. A non-alternating lap splicing device for successively splicing rolls of web material, said device comprising:

(a) a cabinet including an intermediate wall member generally dividing said cabinet into two compartments;

(b) a first driven spindle for supporting a first roll of web within a first of said two compartments;

(c) a second driven spindle for supporting a second roll of web within a second of said two compartments;

(d) a first film gripper lift assembly located within the first of said two compartments for receiving web from said first roll of web;

(e) a second film gripper lift assembly within the second of said two compartments for receiving web from said second roll of web;

(f) an oscillator assembly having a web path therethrough, said oscillator assembly including a cutting knife and a bonding means mounted therein along said web path, said oscillator assembly oscillating from a first position where said web path is in line with said first film gripper lift assembly to a second position where said web path is in line with said second film gripper lift assembly, said cutting knife cutting the web of a substantially spent roll to thereby create a trailing end, said oscillator assembly positioning said trailing end of said substantially spent roll against a lead end of a new roll of web, said bonding means automatically splicing said trailing end and said lead end together to create a lap slice where the overlapping lap of the lap splice is always trailing and on the same side of the film path downstream of said oscillator assembly.

10. A non-alternating lap splicing device as recited in claim 9 further comprising:

(a) an operator access door for each of said compartments;

(b) means for automatically cutting power to one of said two compartments when the operator access door of that one of said two compartments is opened.

11. A non-alternating lap splicing device as recited in claim 9 wherein:

said bonding means is a ultrasonic horn and anvil.

12. A non-alternating lap splicing device for successively splicing rolls of web material, said device comprising:

(a) a first spindle means for supporting a first roll of web;

(b) a second spindle means for supporting a second roll of web;

(c) an oscillator assembly having a web outlet path therethrough and including a cutting knife and a bonding means mounted therein along said web outlet path;

(d) a first web inlet path from said first roll of web to said oscillator assembly;

(e) a second web inlet path from said second roll of web to said oscillator assembly, said oscillator assembly oscillating from a first position where said web outlet path is in line with said first web inlet path to a second position where said web outlet path is in line with said second web inlet path, said cutting knife cutting the web of a substantially spent roll to thereby create a trailing web end, said oscillator assembly positioning said trailing web end of said substantially spent roll against a lead end of a new roll of web, said bonding means automatically splicing said trailing web end and said lead end together to create a lap slice where the overlapping lap of the lap splice is always trailing and on the same side of the film path downstream of said oscillator assembly.

* * * * *